US006273080B1

(12) United States Patent
Sullivan, Jr.

(10) Patent No.: US 6,273,080 B1
(45) Date of Patent: Aug. 14, 2001

(54) PAINT BALL GUN BARREL WITH MULTIPLE COMPRESSION ZONES

(76) Inventor: Dennis J. Sullivan, Jr., 145 S. Rennell, San Dimas, CA (US) 91773

( * ) Notice: Subject to any disclaimer, the term of this patent is extended or adjusted under 35 U.S.C. 154(b) by 0 days.

(21) Appl. No.: 09/553,972

(22) Filed: Apr. 20, 2000

(51) Int. Cl.[7] ..... F41B 11/00
(52) U.S. Cl. ..... 124/84; 124/73; 124/83
(58) Field of Search ..... 124/56, 58, 73, 124/74, 83, 84; 285/396, 402

(56) References Cited

U.S. PATENT DOCUMENTS 985,308 * 2/1911 VanVoorhis .
2,003,290 * 6/1935 Gurney et al. .
2,117,935 * 5/1938 Benjamin et al. ..... 124/84
3,989,027 * 11/1976 Kahelin ..... 124/84 X
4,644,930 * 2/1987 Mainhardt ..... 124/84 X
5,630,406 * 5/1997 Dumont ..... 124/56

FOREIGN PATENT DOCUMENTS

2602455 * 8/1977 (DE) ..... 124/84
1033880 * 6/1966 (GB) ..... 124/84

* cited by examiner

*Primary Examiner*—John A. Ricci
(74) *Attorney, Agent, or Firm*—Sheldon & Mak; Denton L. Anderson

(57) ABSTRACT

A combination including a paint ball gun with a gun barrel has both a muzzle portion and at least two interchangeable compression zone portions of slightly differing diameters. The compression zone portions are preferably attachable and deattachable from the muzzle portion by a non-threaded connection mechanism, such as by a snap-on type connection mechanism, a cam-lock type connection mechanism or a bayonet connection mechanism. The invention allows the user of a paint ball gun to select a compression zone portion which is most optimally matched to the diameter of the paint ball ammunition to be used in the paint ball gun. The invention thereby optimizes paint ball gun performance.

6 Claims, 7 Drawing Sheets

PAINT BALL GUN BARREL WITH MULTIPLE COMPRESSION ZONES

FIELD OF THE INVENTION

This invention relates generally to paint ball guns and, more particularly, to gun barrels suitable for paint ball guns.

BACKGROUND OF THE INVENTION

The use of paint ball guns has become a very popular recreational sport. Paint ball gun competitions are generally very competitive, demanding paint ball guns capable of high efficiency and high performance.

Paint ball guns are almost universally made to propel a paint ball having an external diameter between about 0.675 inches and about 0.695 inches using a source of compressed gas, such as carbon dioxide. In the operation of a typical paint ball gun, a paint ball is deposited into the compression zone portion of the gun barrel. Thereafter, when the trigger is pulled, a short blast of compressed gas propels the paint ball through the compression zone portion and out the muzzle portion. It is important in the performance of paint ball guns that the internal diameter of the compression zone portion closely matches the external diameter of the paint ball ammunition. The internal diameter of the compression zone portion should be within about 0.002 inches of the external diameter of paint ball ammunition. Smaller diameters will tend to cause the paint ball to break up within the compression zone portion or become lodged within the compression zone portion. Larger diameters will result in decreased projecting power (because an undue amount of compressed gas will leak around the outside of the paint ball).

A problem for the competitive paint ball gun user arises from the fact that the external diameter of the paint ball ammunition varies from manufacturer to manufacturer and even from production vats to production vats. Heretofore, there has been no known solution to this problem. Accordingly, there is a need for an inexpensive yet efficient combination which avoids this problem in the prior art.

SUMMARY

The invention satisfies this need. In one embodiment, the invention is a combination comprising a paint ball gun with a gun barrel having a muzzle portion and at least two interchangeable compression zone portions having slightly differing internal diameters.

In a preferred version of this embodiment, the compression zone portions are attachable and deattachable from the muzzle portion by a non-threaded connection mechanism, such as a snap-on type connection mechanism, a cam-lock type connection mechanism or a bayonet type connection mechanism. In another embodiment, the invention is a kit comprising at least two compression zone portions of a gun barrel suitable for use in a paint ball gun, wherein each compression zone portion is readily attachable and deattachable from the muzzle portion of the paint ball gun barrel. In the kit, each compression zone portion has a slightly different internal diameter.

In another embodiment, the invention is a method for using a paint ball gun having multiple, interchangeable compression zone portions. In the method, the user selects a particular batch of paint ball ammunition and then chooses a particular compression zone portion most optimum for use with the paint ball ammunition. The compression zone portion is attached to the muzzle portion within the paint ball gun barrel and the paint ball gun is thereafter used to discharge paint balls with optimum power and efficiency.

DRAWINGS

These features, aspects and advantages of the present invention will become better understood with regard to the following description, appended claims and accompanying figures where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a gun barrel 10 suitable for a gas powered gun 12, such as a paint ball gun. In a gas powered gun 12, a projectile, such as a paint ball, is contacted with a high pressure burst of compressed gas which propels the projectile out of the gun barrel 10 towards the target. More specifically, when the gun 12 is fired, the high pressure gas causes the projectile to rapidly accelerate to a high velocity. In the first 4–8 inches of the gun barrel 10, the pressure experienced by the projectile is very high. As the projectile increases in velocity in this first 4–8 inches of the gun barrel 10, the high pressure is rapidly dissipated as the pressure energy is converted into the kinetic energy of the accelerating projectile. This first 4–8 inches of the gun barrel 10 after the projectile is initially subjected to the burst of high pressure gas is referred to herein as the compression zone portion 14 of the gun barrel 10. The remainder of the gun barrel 10 is referred to herein as the muzzle portion 16.

Figure 1:
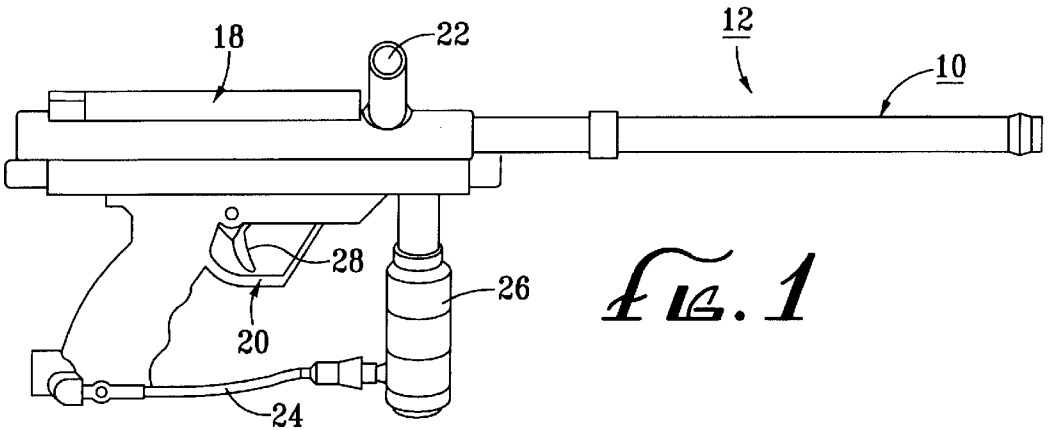
FIG. 1 is a side view of a paint ball gun having features of the invention.
Figure 2:
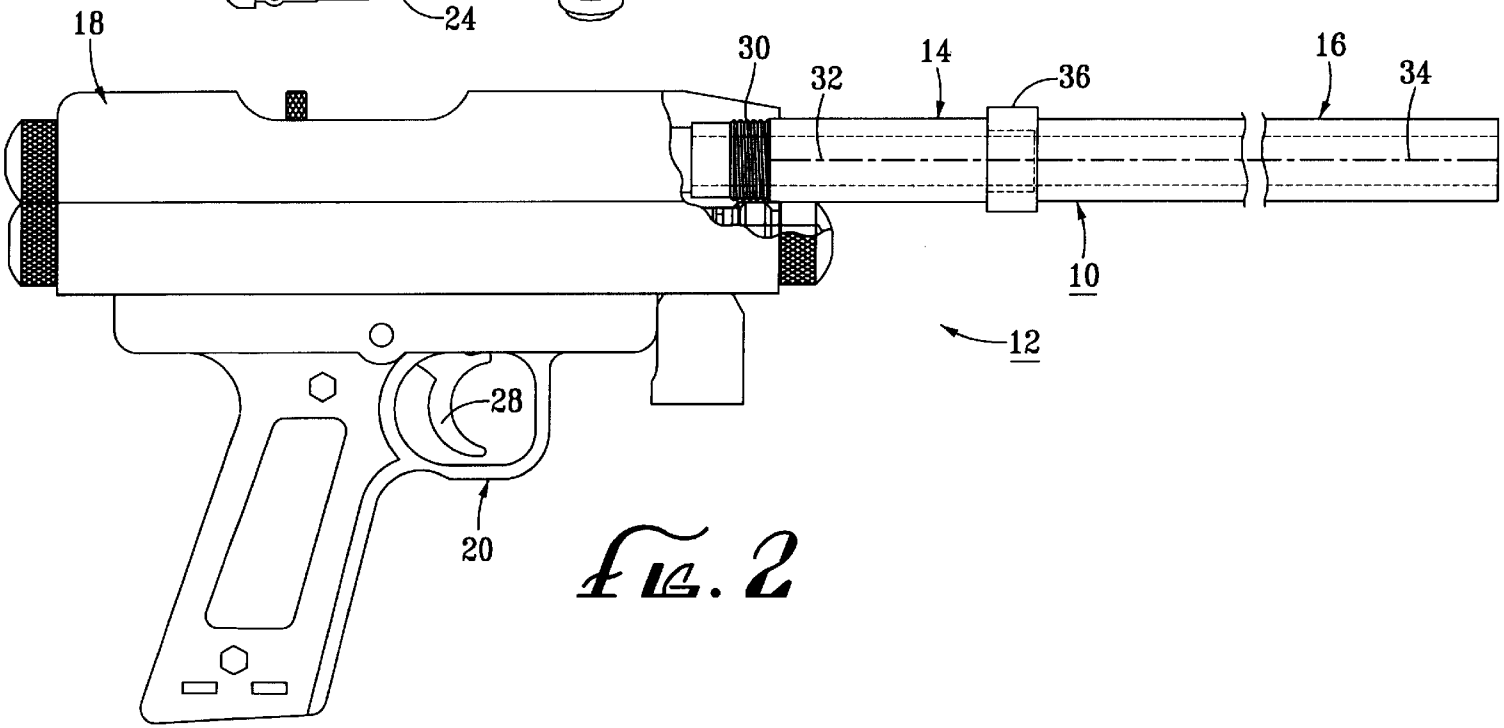
FIG. 2 is a side view in partial cross-section of a paint ball gun having features of the invention.
Figures 3, 7, 8, 9, 10:
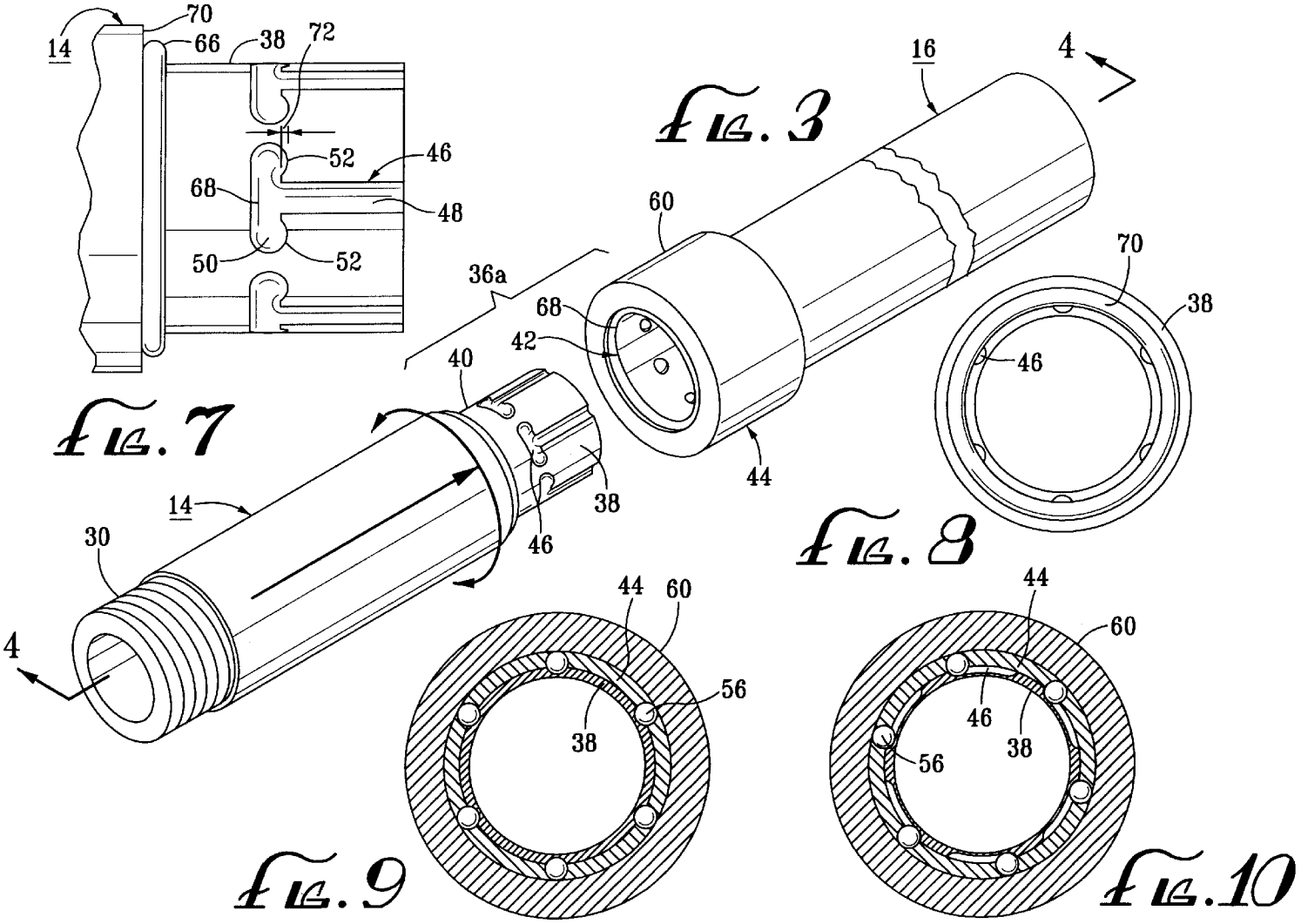
FIG. 3 is an exploded isometric view of a first gun barrel having features of the invention.
FIG. 7 is a detailed side view of the gun barrel illustrated in FIG. 3.
FIG. 8 is a cross-sectional end view of the gun barrel illustrated in FIG. 4, taken along line 8—8.
FIG. 9 is a cross-sectional end view of the gun barrel illustrated in FIG. 5, taken along line 9—9.
FIG. 10 is a cross-sectional end view of the gun barrel illustrated in FIG. 6, taken along line 10—10.
Figure 4:
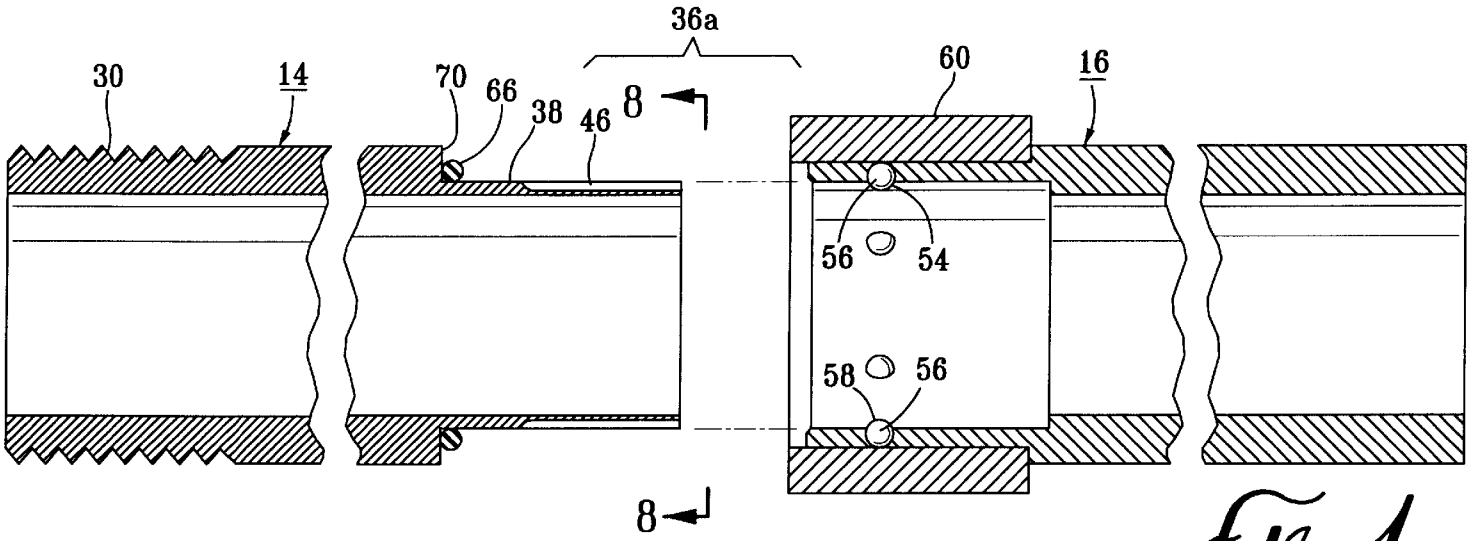
FIG. 4 is a cross-sectional side view of the gun barrel illustrated in FIG. 3, taken along line 4—4.

FIGS. 1 and 2 illustrate a typical paint ball gun 12 wherein the gun barrel 10 of the invention can advantageously be used. As illustrated in FIG. 1, a typical paint ball gun 12 has a main body 18 which includes an internal firing chamber (not shown) and a trigger mechanism 20. A loading port 22 is disposed on the upper portion of the main body 18 which allows projectiles to be gravitated into the firing chamber. Compressed gas from a compressed gas canister (not shown), which is commonly attached to the rear of the main body 18, provides compressed gas to the firing chamber via a short length of hose 24 and an internal gas conduit disposed within the foregrip 26. In a typical operation of the paint ball gun 12 illustrated in FIG. 1, a single projectile is gravitated into the firing chamber via the loading port 22, the gun 12 is aimed at a target, the trigger 28 is squeezed causing the release of high pressure gas from the canister to the firing chamber via the hose 24 and internal gas conduit. The burst of high pressure gas is directed into the firing chamber which propels the projectile through the compression zone portion 14 of the gun barrel 10, then through the muzzle portion 16 of the gun barrel 10 and finally outwardly towards the target.

Typically, the gun barrel 10 is attached to the gun 12 by a threaded connection 30 as illustrated in FIG. 2. Both the compression zone portion 14 and the muzzle portion 16 have longitudinal axes 32 and 34, respectively. In the invention, the compression zone portion 14 is rigidly and coaxially attached to the muzzle portion 16 by a non-threaded connection mechanism 36. The non-threaded connection mechanism 36 can be any of a large number of non-threaded connection mechanisms 36 known in the art. By way of example only, the non-threaded connection mechanism 36 can be a bayonet type connection mechanism 36*a*, a snap-on type connection mechanism 36*b* or a cam-lock type collection mechanism 36*c*.

FIGS. 3–10 illustrate an embodiment of the invention wherein the non-threaded connection mechanism 36 is a bayonet type connection mechanism 36*a*. In this embodiment, the distal end 38 of the compression zone portion 14 is a male connector 40 which is connectable to a corresponding female connector 42 on the proximal end 44 of the muzzle portion 16. The male connector 40 on the distal end 38 of the compression zone portion 14 has a plurality of T-shaped grooves 46 best seen in FIGS. 3 and 7. Each T-shaped groove 46 has a coaxial stem portion 48 and opposed wing portions 50. Preferably, each wing portion 50 has a rounded proximal edge 52, the advantage of which is explained below.

The male connector 42 at the proximal end 44 of the muzzle portion 16 has a plurality of keys 54, each adapted and aligned to engage into the stem portion 48 of each T-shaped groove 46 in the male connector 40 at the distal end 38 of the compression zone portion 16. In the embodiment illustrated in the drawings, the keys 54 are ball bearings 56, each of which is captured within a ball bearing aperture 58. The ball bearing apertures 58 are sized and dimensioned to allow the ball bearings 56 to be retained non-rigidly within the ball bearing apertures 58. The diameter of each of the ball bearings 56 is greater than the thickness of the proximal end 44 of the muzzle portion 16. A collar 60 is disposed over the plurality of ball bearings 56 to rigidly protrude the ball bearings 56 into the interior 62 of the proximal end 44 of the muzzle portion 16. As so rigidly retained, the ball bearings 56 effectively act as keys 54 for locking into the T-shaped grooves 46 in the distal end 38 of the compression zone portion 14.

Figure 6:
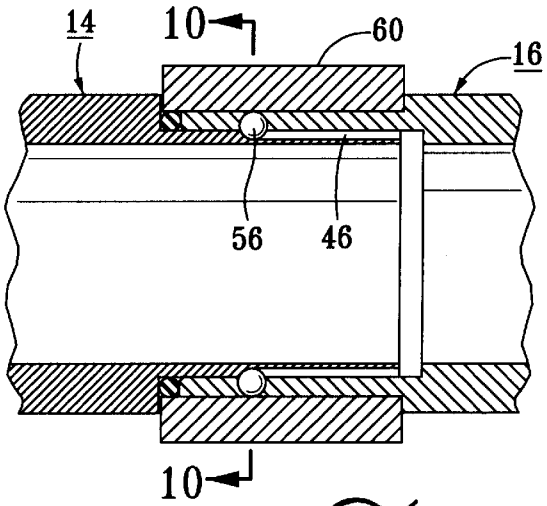
FIG. 6 is a detail cross-sectional side view further illustrating the operation of the gun barrel illustrated in FIG. 3.
Figure 5:
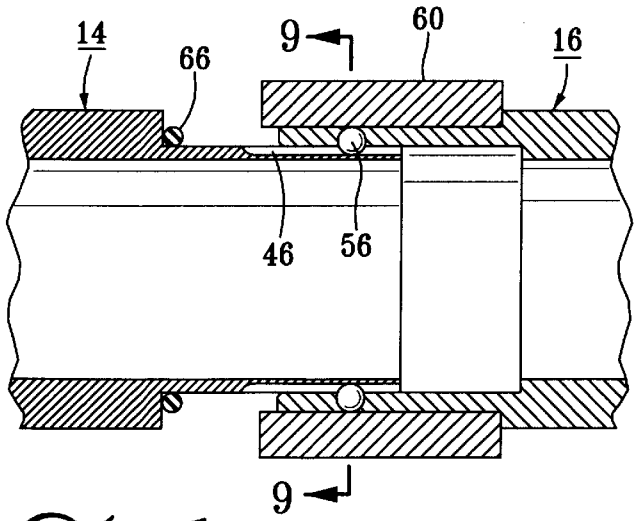
FIG. 5 is a detail cross-sectional side view illustrating the operation of the gun barrel illustrated in FIG. 3.
Figures 11, 15, 16, 17:
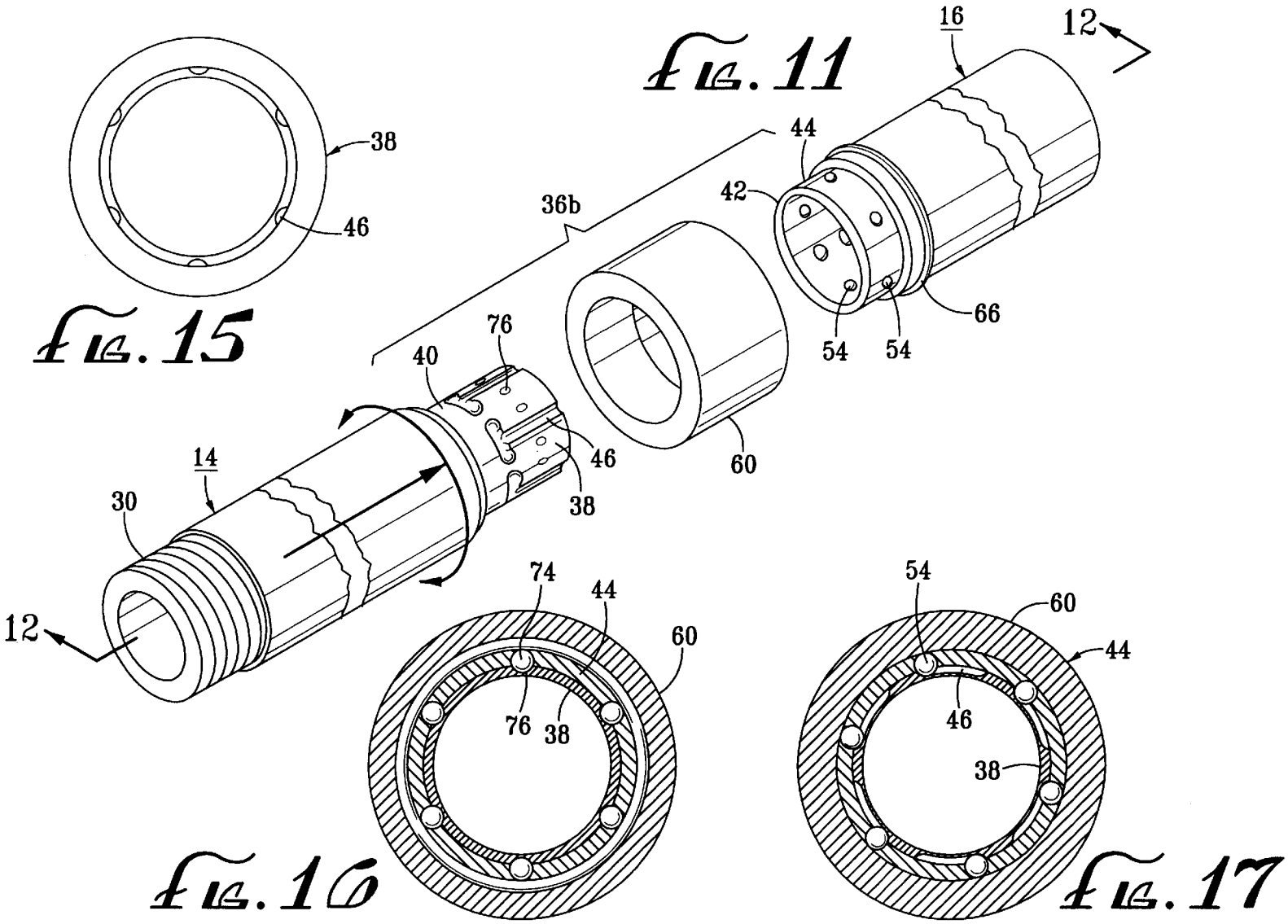
FIG. 11 is an exploded isometric view of a second gun barrel having features of the invention.
FIG. 15 is a cross-sectional end view of the gun barrel illustrated in FIG. 12 taken along line 15—15.
FIG. 16 is a cross-sectional end view of the gun barrel illustrated in FIG. 13 taken along line 16—16.
FIG. 17 is a cross-sectional end view of the gun barrel illustrated in FIG. 14 taken along line 14—14.
Figure 12:
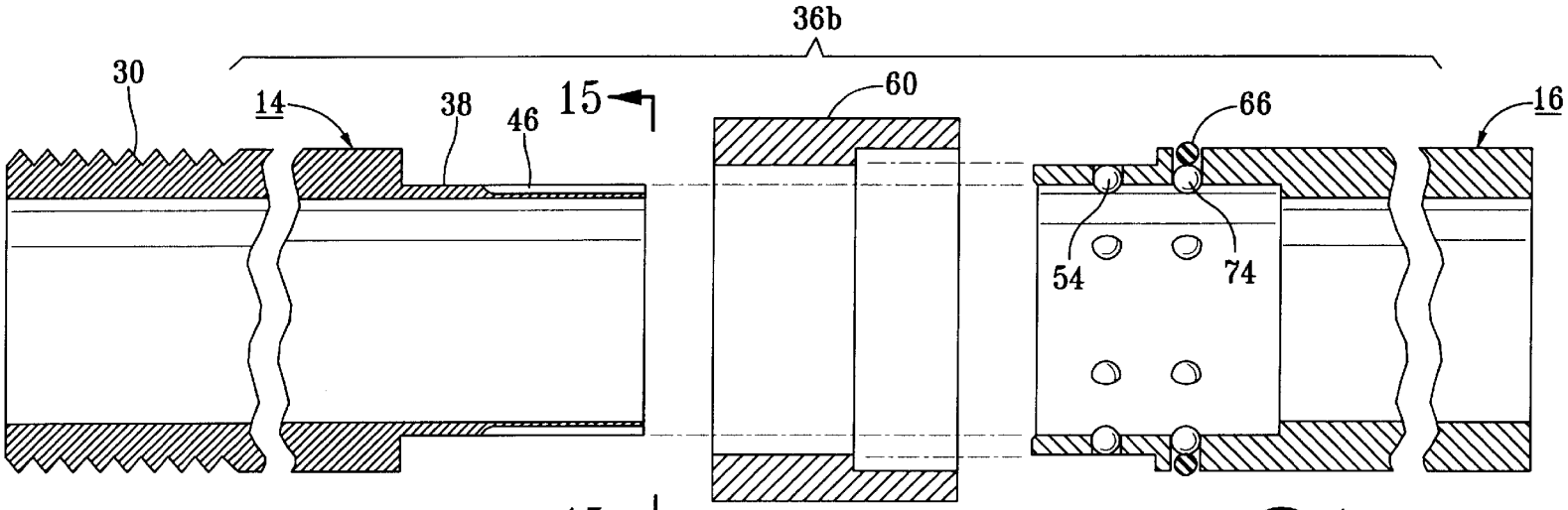
FIG. 12 is a cross-sectional side view of the gun barrel illustrated in FIG. 6, taken along line 12—12.
Figure 14:
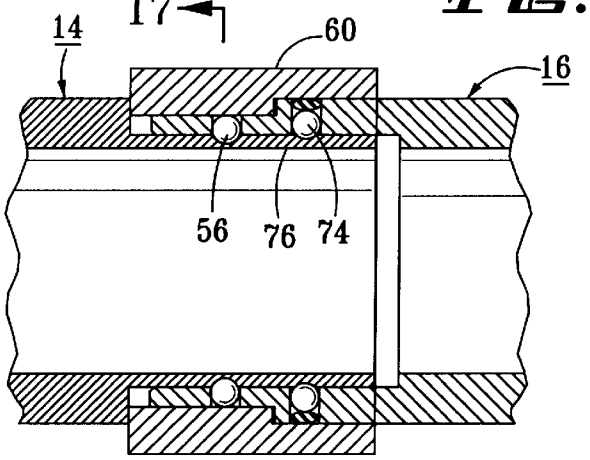
FIG. 14 is a detail cross-sectional side view further illustrating the operation of the gun barrel illustrated in FIG. 11.
Figure 13:
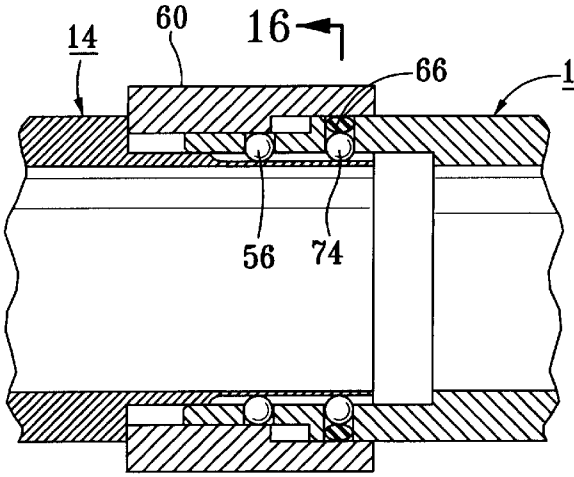
FIG. 13 is a detail cross-sectional side view illustrating the operation of the gun barrel illustrated in FIG. 11.

FIGS. 4–6 and 8–10 illustrate the male/female connection of the distal end 38 of the compression zone portion 14 with the proximal end 44 of the muzzle portion 16. As can be seen in these figures, the distal end 38 of the compression zone portion 14 is inserted into the proximal end 44 of the muzzle portion 16 after aligning each of the keys 54 with a corresponding stem portions 48 of the T-shaped grooves 46. As illustrated in FIGS. 5 and 6, the male connector 40 and the female connector 42 are thrust toward each other until each key 54 is disposed at the uppermost portion 64 of the stem section 48 of each T-shaped groove 46. Then, the muzzle portion 16 is rotated, either clockwise or counterclockwise, to locate each key 54 into one of the wing portions 56 of the T-shaped groove 46. By this action, the muzzle portion 16 is rigidly attached to the compression zone portion 14.

As illustrated in the drawings, it is preferable that a resilient member 66, such as an O-ring, be disposed at the interface between the proximalmost portion 68 of the muzzle portion 16 and a shoulder 70 defined near the distal end 38 of the compression zone portion 14. When the muzzle portion 16 is rigidly attached to the compression zone portion 14, the resilient member 66 reenforces the rigidity of the attachment by resiliently retaining each key 54 within a rounded proximal edge 52 of a wing portion 50 in each of the T-shaped grooves 46. Typically, the rounded proximal edge 52 in each wing portion 50 of the T-shaped grooves 46 has a depth 72 of between about 0.010 inches and about 0.050 inches, preferably between about 0.012 inches and about 0.020 inches.

FIGS. 11–17 illustrate an embodiment of the invention wherein the non-threaded connection mechanism 36 is a snap-on type connection mechanism 36*b*. In this embodiment, the distal end 38 of the compression zone portion 14 is also a male connector 40 which is connectable to a corresponding female connector 42 on the proximal end 44 of the muzzle portion 16. The male connector 40 on the distal end 38 of the compression zone portion 14 also has a plurality of T-shaped grooves 46 similar to those described with respect to the embodiment illustrated in FIGS. 3–10.

Also similar to the embodiment illustrated in FIGS. 3–10, the female connector 42 in the embodiment illustrated in FIGS. 11–17 has a plurality of keys 54, each adapted and aligned to engage into the stem portion 48 of each T-shaped groove 46 at the distal end 38 of the compression zone portion 14. The keys 54 are again ball bearings 56, each of which is captured within a ball bearing aperture 58. The ball bearing apertures 58 are sized and dimensioned to allow the ball bearings 56 to be non-rigidly retained within the ball bearing apertures 56. The diameter of each of the ball bearings 56 is greater than the thickness of the proximal end 44 of the muzzle portion 16. A collar 60 is disposed over the plurality of ball bearings 56 to rigidly protrude the ball bearings 56 into the interior 62 of the proximal end 44 of the muzzle portion 16. As so rigidly retained, the ball bearings 56 effectively act as keys 54 for locking into the T-shaped grooves 46 in the distal end 38 of the compression zone portion 14.

In the embodiment illustrated in FIGS. 11–17, the female connector 42 on the proximal end 44 of the muzzle portion 16 has a plurality of detents 74, each adapted and aligned to engage into a corresponding dimple 76 on the male connector 40 at the distal end 38 of the compression zone portion 14. In the embodiment illustrated in FIGS. 11–17, the detents 74 are also ball bearings 56, each of which is captured within a ball bearing aperture 58. The ball bearing apertures 58 are sized and dimensioned to allow the ball bearings 56 to be non-rigidly retained within the ball bearing apertures 58. The diameter of each of the ball bearings 56 is greater than the thickness of the proximal end 44 of the muzzle portion portion 16. A resilient member 66, such as an O-ring, is disposed over the plurality of detents 74 to urge the ball bearings 56 into the interior 62 of the proximal end 44 of the muzzle portion 16. These ball bearings 56 are not rigidly retained in the ball bearing apertures 58, but are resiliently retained within the ball bearing apertures 58 by the resilient member 66. By this design, each of the detents 74 can be snapped into and snapped out of a corresponding dimple 76.

FIGS. 18–24 illustrate an embodiment of the invention wherein the non-threaded connection mechanism 36 is a cam-lock type connection mechanism 36*c*. In this embodiment, the distal end 38 of the compression zone portion 14 is also a male connector 40 which is connectable to a corresponding female connector 42 on the proximal end 44 of the muzzle portion 16.

In the embodiment illustrated in FIGS. 18–24, the female connector 42 has a plurality of detents 74, each adapted and aligned to engage into a corresponding dimple 76 on the male connector 40 at the distal end 38 of the compression zone portion 14. In the embodiment illustrated in FIGS. 18–24, the detents 74 are also ball bearings 56, each of which is captured within a ball bearing aperture 58. The ball bearing apertures 58 are sized and dimensioned to allow the ball bearings 56 to be non-rigidly retained within the ball bearing apertures 58. The diameter of each of the ball bearings 56 is greater than the thickness of the proximal end 44 of the muzzle portion 16. Resilient members 66, such as a pair of O-rings, are disposed over the plurality of detents 74 to urge the ball bearings 56 into the interior 62 of the proximal end 44 of the muzzle portion 16. The ball bearings 65 are not rigidly retained in the ball bearing apertures 58, but are resiliently retained within the ball bearing apertures 58 by the resilient members 62.

An eccentric collar 78 is disposed over the female connector 42 at the proximal end 44 of the muzzle portion 16. The eccentric collar 78 has a plurality of "high spots" 80 and "low spots" 82, so that, when the eccentric collar 78 is rotated, the eccentric collar 78 is alternatively (i) in abutment with resilient members 66 proximate to the ball bearings 56 and (ii) spaced apart from resilient members 66 proximate to the ball bearings 56. When the eccentric collar 78 is in abutment with the resilient members 66, the eccentric collar 78 rigidly holds the ball bearings 56 protruding into the interior 62 of the proximal end 44 of the muzzle portion 16, so as to rigidly retain the ball bearings 56 into the dimples 76 in the male connector 40. When the eccentric collar 78 is spaced apart from the resilient members 66, the ball bearings 56 are free to snap into and out of corresponding dimples 76 within the male connector 40.

By the design illustrated in FIGS. 18–24, a user wishing to connect the female connector 42 with the male connector 40 rotates the eccentric collar 78 until the eccentric collar 78 is spaced apart from the resilient members 66 proximate to the ball bearings 56 within the female connector 42. The male connector 40 is then thrust into the female connector 42 until the ball bearings 56 resiliently snap into corresponding dimples 76 within the male connector 40. Lastly, the eccentric collar 78 is rotated until the eccentric collar 78 becomes in abutment with the resilient members 66 proximate to the ball bearings 56, whereupon the ball bearings 56 are rigidly retained within the dimples 76. When the user wishes to disengage the female connector 42 from the male connector 40, he or she merely reverses the above-described steps.

Figures 18, 22, 23, 24, 25:
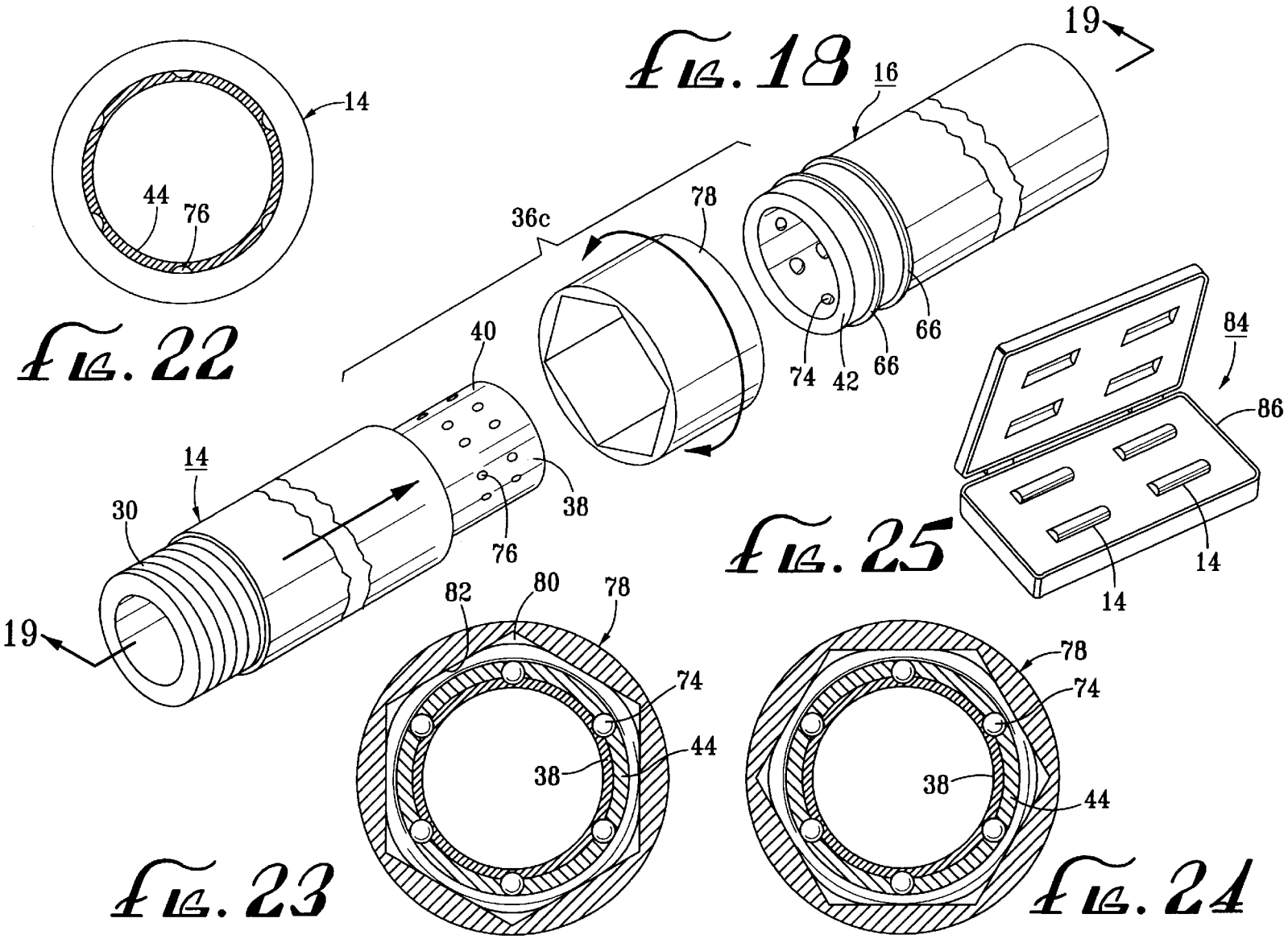
FIG. 18 is an exploded isometric view of a third gun barrel having features of the invention.
FIG. 22 is a cross-sectional end view of the gun barrel illustrated in FIG. 19 taken along line 22—22.
FIG. 23 is a cross-sectional end view of the gun barrel illustrated in FIG. 20 taken along line 23—23.
FIG. 24 is a cross-sectional end view of the gun barrel illustrated in FIG. 21 taken along line 24—24.
FIG. 25 is an isometric view of a kit having features of the invention.
Figure 19:
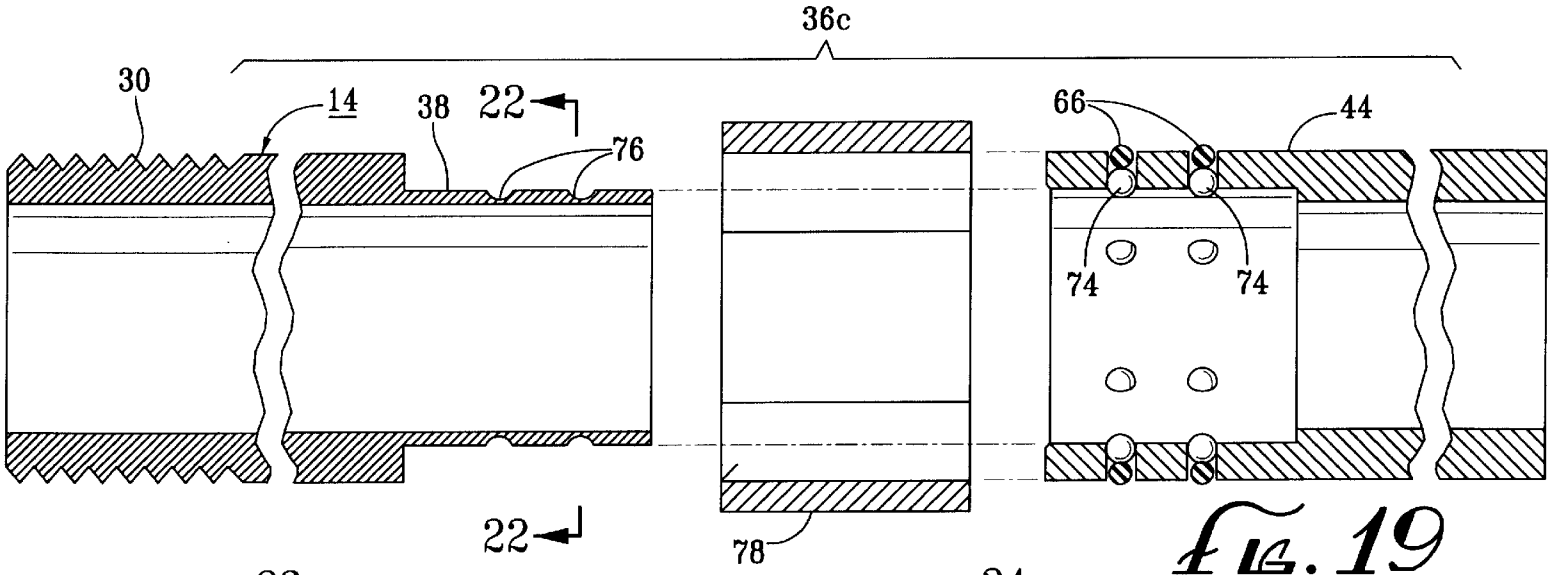
FIG. 19 is a cross-sectional side view of the gun barrel illustrated in FIG. 18 taken along line 19—19.
Figure 21:
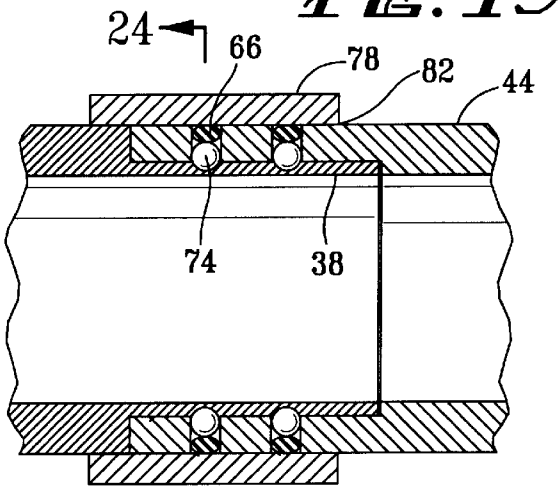
FIG. 21 is a cross-sectional side view further illustrating the operation of the gun barrel illustrated in FIG. 18.
Figure 20:
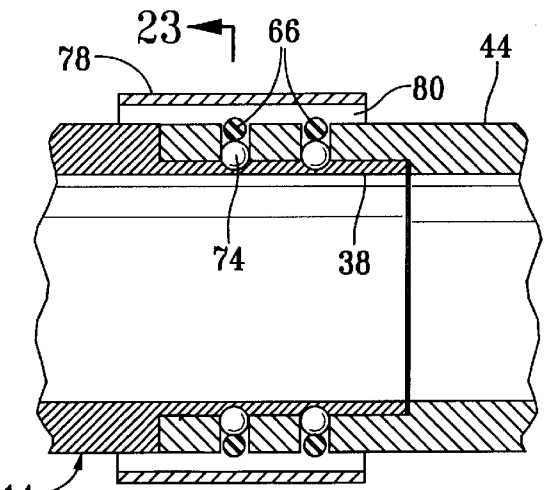
FIG. 20 is a detail cross-sectional side view illustrating the operation of the gun barrel illustrated in FIG. 18.

The invention is also a kit 84 as illustrated in FIG. 25. In the kit 84, a plurality of compression zone portions 14, each having a slightly different internal diameter, are disposed within a convenient carrying container 86. A user wishing to optimize performance of his or her paint ball gun can conveniently use the kit 84 to select a compression zone portion 14 matching the paint ball ammunition to be used in the paint ball gun. The user then assembles the gun barrel 10 using the selected compression zone portion 14.

The invention provides the user with an inexpensive and easy-to-use method for optimizing performance from a paint ball gun or other gas powered gun.

Having thus described the invention, it should be apparent that numerous structural modifications and adaptations may be resorted to without departing from the scope and fair meaning of the instant invention as set forth hereinabove and as described hereinbelow by the claims.

What is Claimed is:

1. A kit comprising at least two compression zone portions of a gun barrel suitable for use in a paint ball gun, each compression zone portion comprising a longitudinal axis, an internal diameter and a length between about 4 inches and about 8 inches, each compression zone portion further comprising a connection mechanism for attaching each compression zone portion to a single muzzle portion, wherein the internal diameter of each compression zone portion is different from the internal diameter of the other compression zone portion.

2. The kit of claim 1 wherein the connection mechanism is selected from the group of connection mechanisms consisting of snap-on type connection mechanisms, cam-lock type connection mechanisms and bayonet-type connection mechanisms.

3. The kit of claim 1 wherein the connection mechanism is a bayonet-type connection mechanism.

4. A combination comprising a muzzle portion, a first compression zone portion and a second compression zone portion, each compression zone portion being coaxially attachable to the muzzle portion to form a gun barrel suitable for use in a paint ball gun, each compression zone portion having an internal diameter different from the internal diameter of the other compression zone portion, so that, the second compression zone portion can be readily substituted for the first compression zone portion, and vice versa, to allow the user of the paint ball gun the ability to match the internal diameter of the compression zone portion used in the paint ball gun with the paint ball ammunition to be used in the paint ball gun.

5. The combination of claim 4 wherein the compression zone portions are attachable to the muzzle portion with a connection mechanism selected from the group of connection mechanisms consisting of snap-on type connection mechanisms, cam-lock type connection mechanisms and bayonet type connection mechanisms.

6. The combination of claim 4 wherein the compression zone portions are attachable to the muzzle portion with a bayonet-type connection mechanism.

* * * * *